US011413724B2

(12) United States Patent
Seo

(10) Patent No.: US 11,413,724 B2
(45) Date of Patent: Aug. 16, 2022

(54) CLAMPING DEVICE

(71) Applicant: SMC CORPORATION, Chiyoda-ku (JP)

(72) Inventor: Takeshi Seo, Nagareyama (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 17/282,477

(22) PCT Filed: Sep. 30, 2019

(86) PCT No.: PCT/JP2019/038453

§ 371 (c)(1),
(2) Date: Apr. 2, 2021

(87) PCT Pub. No.: WO2020/071301

PCT Pub. Date: Apr. 9, 2020

(65) Prior Publication Data

US 2021/0379735 A1 Dec. 9, 2021

(30) Foreign Application Priority Data

Oct. 5, 2018 (JP) ..... JP2018-189995

(51) Int. Cl.
*B25B 5/06* (2006.01)
*B25B 5/12* (2006.01)
*B25B 5/16* (2006.01)

(52) U.S. Cl.
CPC ..... *B25B 5/064* (2013.01); *B25B 5/122* (2013.01); *B25B 5/16* (2013.01)

(58) Field of Classification Search
None
See application file for complete search history.

(56) References Cited

U.S. PATENT DOCUMENTS 6,076,816 A * 6/2000 Tunkers ..... B25B 5/122 269/32
9,999,963 B2 * 6/2018 Takeda ..... B25B 5/122
(Continued)

FOREIGN PATENT DOCUMENTS

EP 0370914 A1 * 5/1990 ..... B25B 5/122
JP 5-1 4458 U 2/1993
(Continued)

OTHER PUBLICATIONS

English Translation of EP 0370914, Biron (Year: 1990).*
(Continued)

*Primary Examiner* — Monica S Carter
*Assistant Examiner* — Sarah Akyaa Fordjour
(74) *Attorney, Agent, or Firm* — Oblon, McClelland, Maier & Neustadt, L.L.P.

(57) ABSTRACT

A clamping device includes a body, a clamp arm and a drive mechanism that includes a displacement body displaced linearly, wherein the clamp arm is rotated based on the displacement of the displacement body. The displacement body includes a guide surface for guiding the rotation of the clamp arm, and also for controlling the rotation of the clamp arm while the clamp arm is in a clamping state. The clamping device further includes a push mechanism disposed at a position facing a lever arm and elastically pushing the displacement body toward the lever arm.

9 Claims, 6 Drawing Sheets

(56) References Cited

U.S. PATENT DOCUMENTS

| | | | | |
|---|---|---|---|---|
| 2004/0061268 | A1* | 4/2004 | Sawdon | B25B 5/087 269/32 |
| 2015/0145195 | A1 | 5/2015 | Fukui et al. | |
| 2017/0036296 | A1 | 2/2017 | Fukui et al. | |
| 2017/0072540 | A1* | 3/2017 | Takeda | B25B 5/16 |

FOREIGN PATENT DOCUMENTS

| | | | |
|---|---|---|---|
| JP | 2002-13510 | A | 1/2002 |
| JP | 2008-264981 | A | 11/2008 |
| JP | 2010-179429 | A | 8/2010 |
| JP | 2014-14913 | A | 1/2014 |
| JP | 2015-13344 | A | 1/2015 |
| JP | 2015-196220 | A | 11/2015 |
| JP | 2015-21 3922 | A | 12/2015 |
| WO | WO 2015/151623 | A1 | 10/2015 |

OTHER PUBLICATIONS

International Search Report and Written Opinion dated Mar. 12, 2020 in PCT/JP2019/038453 filed on Sep. 30, 2019.
Indian Office Action dated Oct. 1, 2021 in Indian Patent Application No. 202147019830, 6 pages.

* cited by examiner

CLAMPING DEVICE

TECHNICAL FIELD

The present invention relates to clamping devices configured to clamp workpieces.

BACKGROUND ART

Japanese Laid-Open Patent Publication No. 2010-179429 discloses a clamping device clamping a workpiece using a clamp arm by rotating the clamp arm based on displacement of a piston and a piston rod. The clamping device includes link mechanisms (first link and second link) disposed between the piston rod and the clamp arm, and the piston rod is provided with, on a side surface adjacent to an end thereof, an inclined part (wedge surface) coming into contact with a curved portion of the clamp. That is, the clamping device uses the link mechanisms to convert the displacement of the piston rod into the rotational motion of the clamp arm, and uses the wedge surface to guide the rotation of the clamp arm and control (lock) the rotation of the clamp arm when the workpiece is in a clamped state.

SUMMARY OF INVENTION

As described in Japanese Laid-Open Patent Publication No. 2010-179429, the clamping device that performs locking by bringing part of the clamp arm (or a rotation portion operating together with the clamp arm) into contact with the inclined part receives clamp reaction force from the clamp arm on the inclined part while the clamp arm is in a clamping state. In this case, a component of the clamp reaction force is applied to the piston rod in a direction along which the piston rod is pushed in. This may cause release of the lock of the clamping state in the clamping device in a case where the clamp reaction force is large.

Moreover, in a case where the thickness of the workpiece varies due to dimensional errors and the like, the piston rod may not reach a predetermined advanced position (position where the clamp arm is locked) even when the clamp arm clamps the workpiece, and the clamping device may not be able to lock the clamp arm. That is, the known clamping device has a narrow lock range to lock the clamping state of the clamp arm, and cannot accommodate variations in the thickness of the workpiece.

The present invention has been devised taking into consideration the aforementioned problems, and has the object of providing a clamping device capable of establishing an excellent locking state and, at the same time, capable of satisfactorily accommodating variations in the thickness of a workpiece by increasing a lock range.

To achieve the above-described object, a clamping device according to an aspect of the present invention comprises a body, a clamp arm rotated relative to the body and configured to hold a workpiece between the clamp arm and a support structure to create a clamping state, a drive mechanism including a displacement body displaced linearly, and configured to rotate the clamp arm based on displacement of the displacement body, and a push mechanism disposed at a position facing the clamp arm or a rotation portion rotated in an integrated manner with the clamp arm, the push mechanism being configured to come into contact with the displacement body to elastically push the displacement body toward the clamp arm or the rotation portion while the displacement body is displaced, wherein the displacement body includes a guide surface coming into contact with the clamp arm or the rotation portion to guide rotation of the clamp arm, and also to control the rotation of the clamp arm while the clamp arm is in the clamping state.

Since the clamping device described above includes the push mechanism elastically pushing the displacement body, the displacement body can be displaced without being interfered, and the guide surface of the displacement body can be brought into firm contact with the clamp arm or the rotation portion while the clamp arm is in the clamping state. Thus, the reliability of the lock (rotation control) of the clamp arm increases, resulting in a sufficient clamping state even when, for example, the size of the clamping device is small. In addition, even when the clamp arm is in the clamping state, the elastic push of the push mechanism provides a lock range allowing variations in the thickness of the workpiece by displacing the displacement body a certain distance. Thus, the clamping device allows dimensional errors in the workpiece and the clamping device and demonstrates stable clamping force.

The above and other objects, features, and advantages of the present invention will become more apparent from the following description when taken in conjunction with the accompanying drawings in which a preferred embodiment of the present invention is shown by way of illustrative example.

DESCRIPTION OF EMBODIMENTS

A preferred embodiment according to the present invention will now be described with reference to the accompanying drawings.

Figure 1:
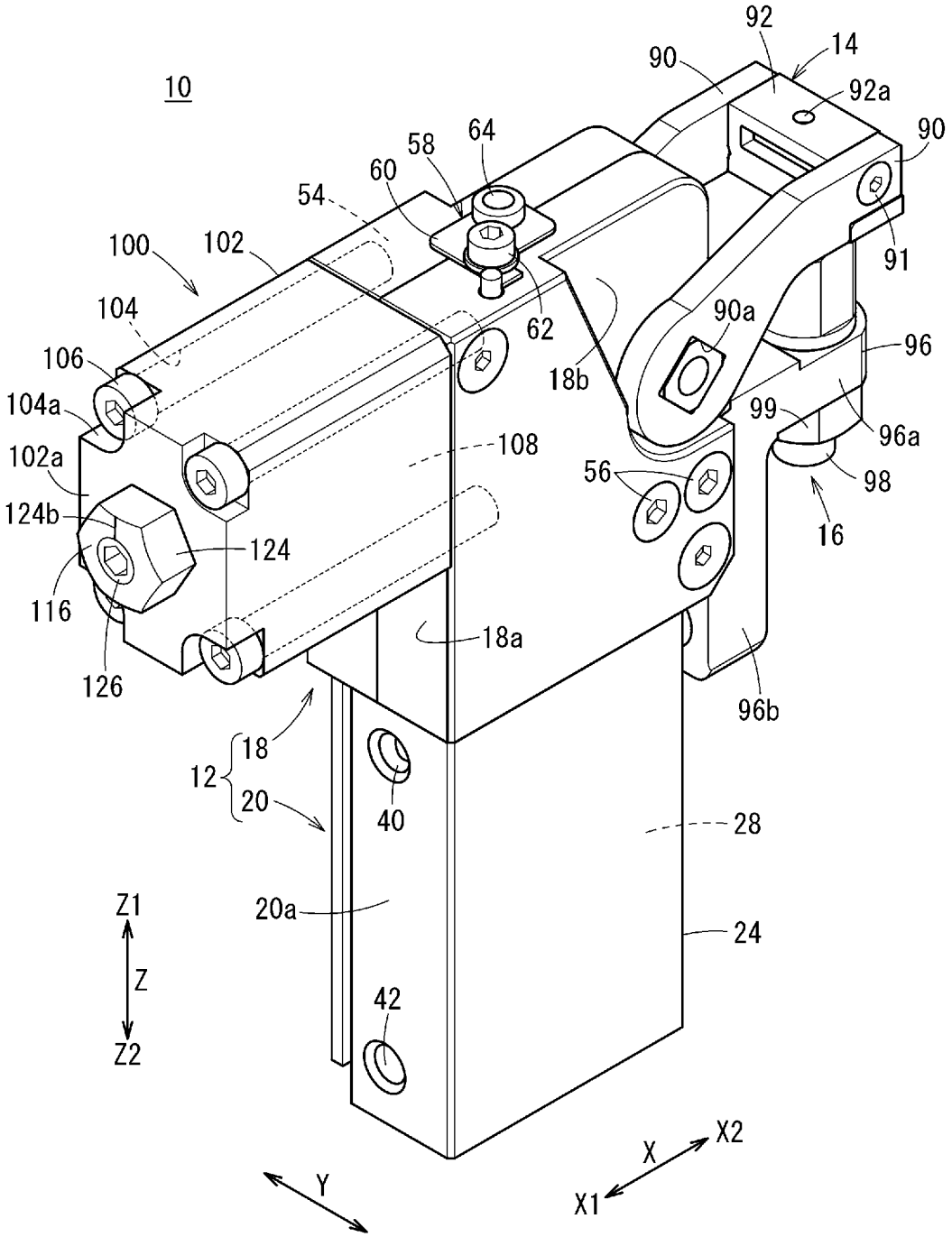
FIG. 1 is a perspective view of a clamping device according to an embodiment of the present invention.

As illustrated in FIG. 1, a clamping device 10 according to an embodiment of the present invention includes a body 12, a clamp arm 14 rotated relative to the body 12, and a support structure 16 secured to the body 12. The clamp arm 14 holds a workpiece W (see FIG. 4) between the clamp arm 14 and the support structure 16 to create a clamping state (gripping state). For example, a plurality of clamping devices 10 are attached to an end effector of a mobile robot in an automotive production line and cooperate with each other to hold and move a shaped part (workpiece W) such as a panel.

Figure 2:
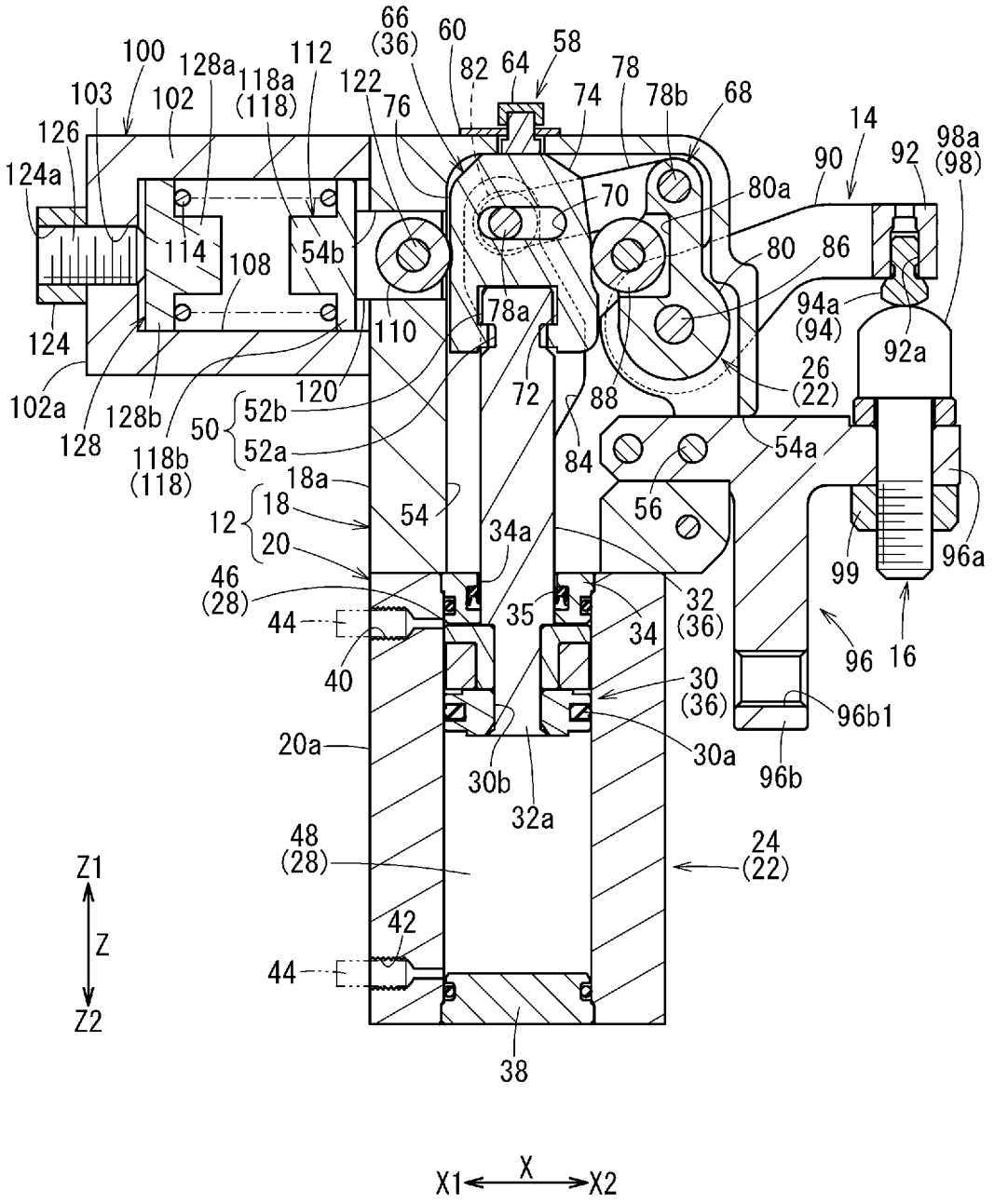
FIG. 2 is a side cross-sectional view of the clamping device in FIG. 1.

The body 12 includes a first housing 18 to which the clamp arm 14 is provided to be rotatable and a second housing 20 connected with a lower end part (on a side at which an arrow Z2 is pointing; hereinafter referred to as "Z2 side") of the first housing 18. As illustrated in FIG. 2, the first and second housings 18 and 20 incorporate a drive mechanism 22. The drive mechanism 22 includes a drive section 24 generating driving force in the second housing 20 and a driving force transmission section 26 rotating the clamp arm 14 in the first housing 18 based on the driving force generated by the drive section 24.

Specifically, as illustrated in FIGS. 1 and 2, a hydraulic cylinder generating linear driving force based on supply and discharge of pressurized fluid such as air serves as the drive section 24. However, any other structures moving linearly (generating liner driving force) based on power supply may be used as the drive section 24 instead of the hydraulic cylinder.

The second housing 20 is a cylinder tube having a rectangular prism (rectangular parallelepiped) shape extending in a direction of an arrow Z (hereinafter referred to as "Z direction") in appearance, and having a cylindrical cylinder chamber 28 therein. The drive section 24 includes the second housing 20, a piston 30 accommodated in the cylinder chamber 28, a piston rod 32 connected with the piston 30, and a rod cover 34 supporting the piston rod 32 such that the piston rod 32 is displaceable. The piston 30 and the piston rod 32 are parts displaceable relative to the second housing 20 and are part of a displacement body 36 in this specification.

An end surface of a first end part of the second housing 20 on a side at which an arrow Z1 is pointing (hereinafter referred to as "Z1 side") is connected with the first housing 18. The cylinder chamber 28 extends in the second housing 20 in the longitudinal direction thereof and passes through both ends of the second housing 20 in the longitudinal direction. A cap 38 airtightly closing the cylinder chamber 28 is fitted in a second end part of the second housing 20.

In a sidewall 20*a* of the second housing 20 on a side at which an arrow X1 is pointing (hereinafter referred to as "X1 side"), a first port 40 connecting the cylinder chamber 28 and the outside is created in the first end part (on the Z1 side), and a second port 42 connecting the cylinder chamber 28 and the outside is created in the second end part (on the Z2 side). During use of the clamping device 10 (integration into production lines), connectors 44 for piping linked to a pressurized fluid supply source (not illustrated) are connected with the first and second ports 40 and 42. The pressurized fluid supply source performs supply and discharge (atmospheric release) of pressurized fluid to and from the first port 40 or the second port 42 in a selective manner.

The piston 30 of the drive section 24 has a disk shape, and a piston packing 30*a* is attached to the outer circumferential surface of the piston 30 via an annular groove. The piston packing 30*a* is in airtight contact with the inner circumferential surface of the cylinder chamber 28 and thereby partitions the cylinder chamber 28 into a rod-side cylinder chamber 46 and a cap-side cylinder chamber 48. The first port 40 is disposed at a position where the first port 40 communicates with the rod-side cylinder chamber 46 at all times even when the piston 30 moves to the Z1 side. The second port 42 is disposed at a position where the second port 42 communicates with the cap-side cylinder chamber 48 at all times even when the piston 30 moves to the Z2 side.

The piston rod 32 extends in the Z direction and includes a secured portion 32*a* secured to the piston 30 on the Z2 side and a connection portion 50 connected with the driving force transmission section 26 on the Z1 side. The piston rod 32 and the piston 30 are integrated with each other by the secured portion 32*a* being swaged while the secured portion 32*a* is inserted in a piston hole 30*b* in the center of the piston 30. The connection portion 50 includes a neck part 52*a* recessed radially inward in a trunk part of the piston rod 32 and a widened part 52*b* adjoining the neck part 52*a* and protruding radially outward from the neck part 52*a*.

The rod cover 34 has a tubular shape with an insertion hole 34*a* in the center thereof and is secured to an opening of the cylinder chamber 28 adjacent to the first housing 18. The rod cover 34 holds the trunk part of the piston rod 32 in the insertion hole 34*a* and guides the displacement of the piston rod 32. A rod packing 35 is attached to the inner circumferential surface of the rod cover 34 via an annular groove. The rod packing 35 is in sliding contact with the outer circumferential surface of the piston rod 32 to thereby prevent leakage of pressurized fluid from the cylinder chamber 28 into the first housing 18.

As illustrated in FIG. 1, the first housing 18 connected with the second housing 20 is shaped into a box by assembling two members in a direction of an arrow Y (hereinafter referred to as "Y direction") and fastening the two members with bolts. The first housing 18 has an accommodation space 54 therein to accommodate the driving force transmission section 26. A surface (lower surface) of the first housing 18 on the Z2 side has an opening communicating with the accommodation space 54, and a first end part (on the Z1 side) of the piston rod 32 is inserted in the accommodation space 54 while the second housing 20 is connected with the first housing 18. The first housing 18 also has an opening 54*a* communicating with the accommodation space 54 at a predetermined position in a side surface of the first housing 18 on a side at which an arrow X2 is pointing (hereinafter referred to as "X2 side"). Part of the support structure 16 is inserted in the opening 54*a*, and fastening bolts 56 are inserted in the support structure 16 through bolt holes created in both side surfaces in the Y direction in the vicinity of the opening 54*a*. With this, the support structure 16 is secured to the body 12.

As illustrated in FIGS. 1 and 2, in the clamping device 10 according to this embodiment, a push mechanism 100 is attached to a surface (side surface 18*a*) of the first housing 18 on the X1 side. The push mechanism 100 is attached to the side surface on the same side as the sidewall 20*a* with which the connectors 44 are connected (surface in which the first and second ports 40 and 42 are created) in the second housing 20. The push mechanism 100 cooperates with the driving force transmission section 26 to create a firm lock (rotation control of the clamp arm 14) while the clamp arm 14 is in the clamping state. The push mechanism 100 will be described later.

An unclamping mechanism 58 for forcibly releasing the clamping state by the clamp arm 14 is disposed on a surface (upper surface) of the first housing 18 on the Z1 side. The unclamping mechanism 58 includes a base 60, a fixing screw 62 fastened to the first housing 18, and a releasing pin 64 capable of entering the accommodation space 54 through the base 60 and the first housing 18. The releasing pin 64 is disposed at a position facing a joint 66 (described later) of the driving force transmission section 26. The releasing pin 64 enters the accommodation space 54 according to user operation, whereby the leading end thereof comes into contact with the joint 66 located on the Z1 side while the clamp arm 14 is in the clamping state, and pushes the joint 66 toward the drive section 24 (the Z2 side).

The driving force transmission section 26 accommodated in the first housing 18 includes the joint 66 connected with the piston rod 32 and a link structure 68 converting the linear displacement of the joint 66 into rotational motion. The joint 66 constitutes the displacement body 36 of the drive mechanism 22 in this specification. That is, the displacement body 36 includes the piston 30, the piston rod 32, and the joint 66, and is displaced linearly in the Z direction.

The joint 66 is shaped into a block that is wide in a direction of an arrow X (hereinafter referred to as "X direction"). The joint 66 has, at a predetermined position in the height direction (Z direction), a slotted hole 70 extending in the X direction. The joint 66 further has, on the Z2 side, a connection recess 72 engaging with the connection portion 50 of the piston rod 32.

The connection recess 72 has a shape similar to and slightly larger than the neck part 52*a* and the widened part 52*b* of the piston rod 32, and is connected with the connection portion 50 with a small clearance. This allows the joint 66 to be displaced in the Z direction together with the piston rod 32 and, at the same time, to move a small distance in the X direction orthogonal to the direction of displacement. For example, the amount of possible displacement of the joint 66 in the X direction with respect to the piston rod 32 is set to about 0.5 mm to 1.0 mm.

A guide surface 74 is formed on a side surface of the joint 66 facing the clamp arm 14 (surface on the X2 side). Moreover, a push surface 76 pushed by the push mechanism 100 is formed on a side surface of the joint 66 on the side (on the X1 side) opposite to the guide surface 74. The guide surface 74 and the push surface 76 will be described later.

Figure 3:
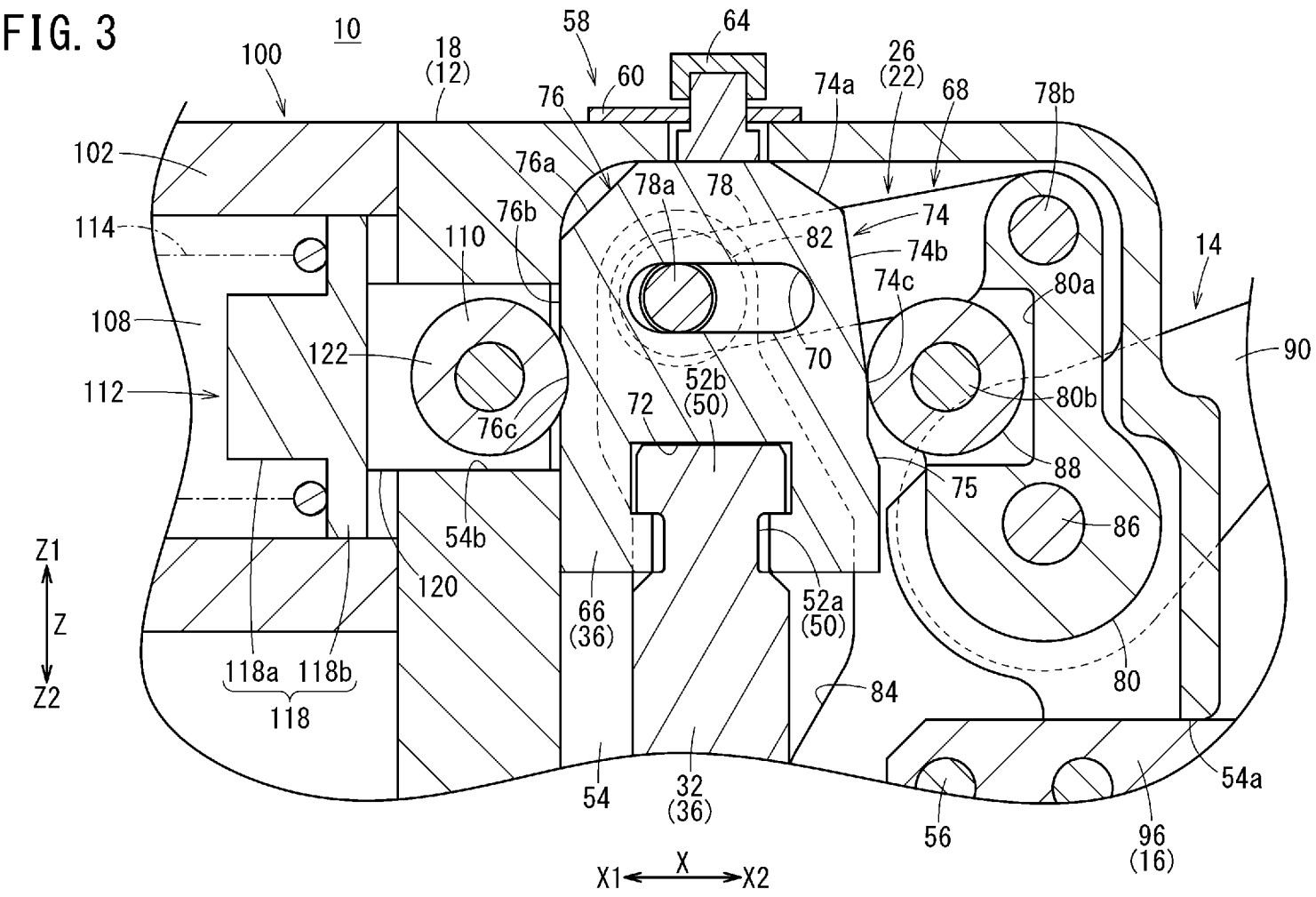
FIG. 3 is an enlarged side cross-sectional view illustrating a structure of a part including a push mechanism in the clamping device in FIG. 2.

As illustrated in FIGS. 2 and 3, the link structure 68 includes a pair of link arms 78 connected with the joint 66 to be rotatable, a lever arm 80 (rotation portion) connected with the pair of link arms 78 to be rotatable, a pair of guide rollers 82 attached to the joint 66 together with the link arms 78 to be rotatable, and a pair of guide grooves 84 formed in the inner surface of the first housing 18 to guide the movement of the pair of guide rollers 82.

The pair of link arms 78 have a flat, elongated shape and are connected with each other by a first pin 78*a* secured to first ends in the longitudinal direction and a second pin 78*b* secured to second ends in the longitudinal direction. The first pin 78*a* is inserted in the slotted hole 70 in the joint 66 to be movable and rotatable, and rotatably supports the pair of guide rollers 82 disposed outside the link arms 78. The second pin 78*b* is supported by a first end of the lever arm 80 to be rotatable.

As described above, the first end of the lever arm 80 is connected with the second ends of the link arms 78 in the longitudinal direction. On the other hand, a second end of the lever arm 80 is connected with a first end of the clamp arm 14 via a support pin 86 to be non-rotatable. The support pin 86 has a rectangular cross-section at connection points with the clamp arm 14 and is rotatably supported by bearing holes (not illustrated) in the first housing 18. That is, in the link structure 68, as the first ends of the link arms 78 are displaced toward the Z2 side with the displacement of the joint 66, the second ends of the link arms 78 rotate the first end of the lever arm 80 counterclockwise in FIG. 2. The lever arm 80 is rotated around the support pin 86, causing the clamp arm 14 to be also rotated counterclockwise. Conversely, as the first ends of the link arms 78 are displaced in the Z1 direction, the second ends of the link arms 78 rotate the first end of the lever arm 80 clockwise, causing the clamp arm 14 to be also rotated clockwise.

The lever arm 80 is provided with a cut-off portion 80*a* at an intermediate position in the direction of extension, and a driving force transmission roller 88 is disposed inside the cut-off portion 80*a*. The driving force transmission roller 88 is supported by a pivot pin 80*b* of the lever arm 80 to be rotatable, and comes into contact with the guide surface 74 of the joint 66 to be rollable. Here, the guide surface 74 of the joint 66 includes an inclined end part 74*a*, an inclined intermediate part 74*b*, and a guide surface-side parallel part 74*c* arranged from the Z1 side to the Z2 side in this order.

The inclined end part 74*a* is significantly inclined with respect to a direction along which the joint 66 is displaced (direction of displacement; Z direction), and extends a short distance. The inclined intermediate part 74*b* is slightly inclined with respect to the direction of displacement of the joint 66 (for example, at 8º) and extends between the inclined end part 74*a* and the guide surface-side parallel part 74*c*. The inclined intermediate part 74*b* extends over the slotted hole 70 in the height direction and extends a longer distance than the inclined end part 74*a* and the guide surface-side parallel part 74*c*. The guide surface-side parallel part 74*c* is parallel to the direction of displacement of the joint 66 (that is, inclined at an angle of 0º with respect to the direction of displacement of the joint 66). The guide surface-side parallel part 74*c* is disposed above the piston 30 and slightly below the slotted hole 70. The guide surface 74 further includes a curved surface 75 on the Z2 side to prevent the driving force transmission roller 88 from passing over.

The pair of guide rollers 82 of the link structure 68 are disposed in the guide grooves 84 created in the first housing 18, and roll along the guide grooves 84 when the joint 66 is displaced. When viewed in side cross-section, the guide grooves 84 extend in the same direction as the axial direction of the piston 30 (Z direction), extend slantingly toward the X2 side at an intermediate position (at the same height as the support pin 86 rotatably supporting the clamp arm 14), and then extend in the Z direction again. When the joint 66 is displaced, the pair of guide rollers 82 and the first ends (first pin 78*a*) of the link arms 78 are slightly displaced also in the X direction according to the guide grooves 84. Thus, the linear motion force of the joint 66 is efficiently transmitted to the link arms 78.

The clamp arm 14 rotated by the above-described driving force transmission section 26 includes a pair of arm portions 90 disposed on both surfaces of the body 12 (first housing 18) in the Y direction and a coupler 92 connecting second ends of the pair of arm portions 90. The first housing 18 has cut-off portions 18*b* on both surfaces thereof in the Y direction, and the pair of arm portions 90 are disposed on the cut-off portions 18*b* to be rotatable.

The pair of arm portions 90 are rotated in an integrated manner with the body 12 interposed therebetween. Square support holes 90*a* into which the support pin 86 with a rectangular cross-section is inserted are created in first ends of the pair of arm portions 90. A connecting screw 91 to connect the coupler 92 is inserted into the second ends of the pair of arm portions 90.

The coupler 92 is a block having a substantially rectangular cross-section, and a vertical screw hole 92*a* for a gripper passes through the coupler 92 in the middle in the width direction. A first gripper 94 is screwed into the screw hole 92*a* to face the support structure 16. The first gripper 94 includes a protrusion 94*a* protruding from the lower surface (surface on the Z2 side) of the coupler 92. The protruding end of the protrusion 94*a* is substantially hemispherical, and the protruding length of the protrusion 94*a* can be changed according to the screwed position of the first gripper 94.

The support structure 16 includes a support 96 having a substantially T shape when viewed from the side. The support 96 is inserted into the opening 54*a* of the first housing 18 and secured by the fastening bolts 56. The support 96 includes a support portion 96*a* protruding from the first housing 18 toward the X2 side, and an attachment portion 96*b* extending from the support portion 96*a* toward the Z2 side. A second gripper 98 is attached to a first end part of the support portion 96*a*.

The second gripper 98 is created as a screw structure including a head 98*a* larger than the protrusion 94*a* of the first gripper 94 and is attached such that the head 98*a* protrudes from the support portion 96*a* toward the Z1 side. The protruding end of the head 98*a* is substantially hemispherical. A nut 99 is screwed onto the second gripper 98 from below the support portion 96*a*, so that the second gripper 98 is firmly secured to the support 96.

The attachment portion 96*b* extends a predetermined length downward (toward the Z2 side) from the support portion 96*a*, and the end thereof has an attachment screw hole 96*b*1. The attachment screw hole 96*b*1 is used to secure the clamping device 10 to another member during installation into a production line.

As illustrated in FIGS. 1 and 2, the push mechanism 100 of the clamping device 10 includes a push mechanism housing 102 attached to the side surface 18*a* of the first housing 18 on the X1 side. The push mechanism housing 102 has a box shape, and, when attached, is flush with both side surfaces of the first housing 18 in the Y direction and the surface (upper surface) thereof on the Z1 side. The size of the push mechanism housing 102 in the Z direction is smaller than that of the first housing 18.

Screw notches 104*a* are created in an end surface 102*a* of the push mechanism housing 102 on the X1 side at the four corners and communicate with screw holes 104 for attaching the push mechanism 100 to the body 12. The screw holes 104 extend in the X direction and face blind holes (not illustrated) in the first housing 18 when the push mechanism housing 102 is attached to the first housing 18. Attachment bolts 106 passing through the screw holes 104 are screwed into the blind holes to secure the push mechanism 100. As illustrated in FIGS. 2 and 3, the first housing 18 has a communicating hole 54*b* extending in the X direction to communicate with the accommodation space 54 at a position where the push mechanism housing 102 is attached.

A cylindrical space 108 is formed inside the push mechanism housing 102. The space 108 accommodates a push roller 110 capable of entering the accommodation space 54 through the communicating hole 54*b*, a roller holder 112 by which the push roller 110 is supported to be rotatable, and a compression spring 114 (biasing member) biasing the roller holder 112. The end surface 102*a* of the push mechanism housing 102 on the X1 side is provided with an adjuster 116 (see FIG. 1) adjusting the biasing force of the compression spring 114.

When the push mechanism 100 is attached to the first housing 18, the push roller 110 is disposed at a position facing the lever arm 80 (rotation portion) disposed inside the accommodation space 54. The size of the push roller 110 is similar to that of the driving force transmission roller 88, and, when the joint 66 is displaced, the push roller 110 rolls on the push surface 76 of the joint 66 on the side (on the X1 side) opposite to the guide surface 74, while in contact with the push surface 76. The structure pushing the joint 66 (displacement body 36) while in contact is not limited to the push roller 110. For example, instead of the push roller 110, the push mechanism 100 may include a contact body (not illustrated) of which surface brought into contact with the joint 66 has a low frictional coefficient. Such a contact body may be formed of a low friction material or surface-treated (by grinding, applying lubricant, or the like) such that the contact body slides due to the low frictional coefficient.

The push surface 76 includes an inclined end part 76*a* on the Z1 side and a push surface-side parallel part 76*b* adjoining the inclined end part 76*a* and extending parallel to the direction of displacement of the joint 66 (Z direction). The push surface 76 further includes a concave part 76*c* in which the push roller 110 can slightly fit when the joint 66 moves to a stroke end position on the Z1 side (while the clamp arm 14 is in the clamping state). For example, when viewed in section, the concave part 76*c* has an arc shape with the same curvature as the push roller 110 and a depth of about 0.2 mm.

The roller holder 112 includes a bias receiving portion 118, a pair of protruding pieces 120 protruding from the bias receiving portion 118 in the direction of the arrow X2 (hereinafter referred to as "X2 direction"), and a bearing pin 122 by which the push roller 110 is supported to be rotatable. The bias receiving portion 118 includes a protruding part 118*a* inserted inside the compression spring 114, and a disk-shaped seat part 118*b* which protrudes radially outward from the protruding part 118*a* and with which a first end of the compression spring 114 is in contact. The pair of protruding pieces 120 are sized to be inserted in the communicating hole 54*b* together with the push roller 110 and firmly support the bearing pin 122 connecting the pair with each other. The push roller 110 slightly protrudes from the protruding ends of the pair of protruding pieces 120 toward the X2 side.

The compression spring 114 has a cylindrical shape including the first end that is in contact with the seat part 118*b* of the roller holder 112 on the X2 side and a second end on the side (on the X1 side) opposite to the first end. A second end of the compression spring 114 is in contact with an accommodated body 128 of the adjuster 116. That is, the compression spring 114 applies the biasing force (elastic force) in a direction along which the roller holder 112 is separated from the accommodated body 128 (toward the X2 side). The biasing member applying the biasing force to the push roller 110 (roller holder 112) is not limited to the compression spring 114, and may be, for example, a rubber member, a coned-disc spring, or a leaf spring.

The adjuster 116 of the push mechanism 100 includes a fastener 124 exposed to the outside of the push mechanism housing 102, an adjustment screw 126 screwed into a threaded hole 124*a* of the fastener 124, and the above-described accommodated body 128 that is in contact with the adjustment screw 126. Moreover, the end surface 102*a* of the push mechanism housing 102 on the X1 side is provided with a housing screw hole 103 which connects the push mechanism housing 102 and the space 108 and into which the adjustment screw 126 is screwed.

The adjustment screw 126 is rotated with respect to the fastener 124 and the push mechanism housing 102 by a user. This causes the adjustment screw 126 to be displaced in the X direction and thus causes the position of the accommodated body 128 inside the push mechanism housing 102 to be changed. The fastener 124 or the adjustment screw 126 may be provided with a mark 124*b* (see FIG. 1) indicating, for example, the operation amount of the adjustment screw 126 or an adjustment reference for the adjustment screw 126.

The accommodated body 128 has a shape paired with the bias receiving portion 118 of the roller holder 112. That is, the accommodated body 128 includes a protruding part 128*a* inserted inside the compression spring 114, and a disk-shaped seat part 128*b* which protrudes radially outward from the protruding part 128*a* and with which the second end of the compression spring 114 is in contact. The biasing force of the compression spring 114 applied to the roller holder 112 (push roller 110) can be adjusted based on the position of the accommodated body 128 inside the push mechanism housing 102 adjusted using the adjustment screw 126.

Figure 4:
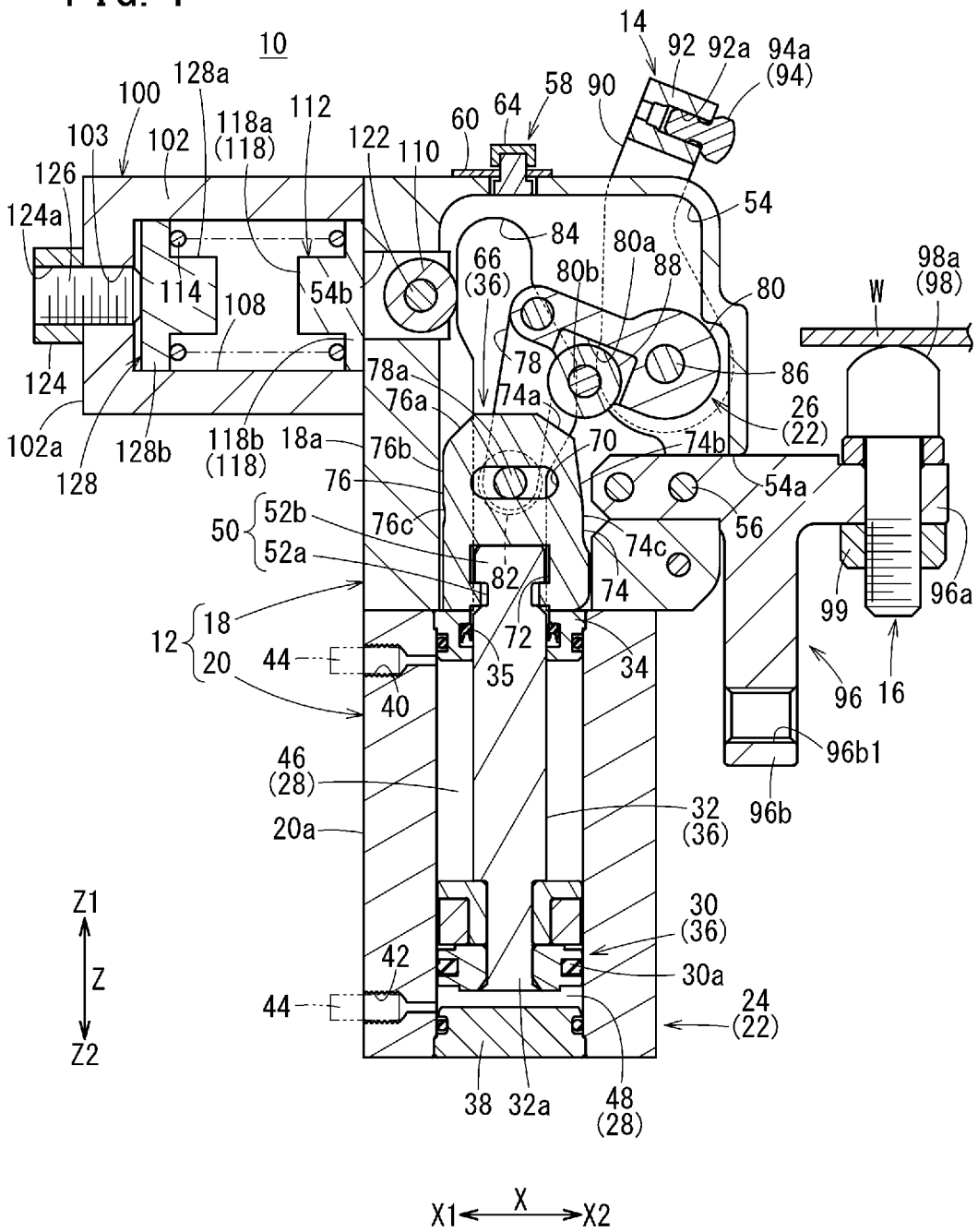
FIG. 4 is a side cross-sectional view illustrating an unclamping state of the clamping device.

The clamping device 10 according to this embodiment is basically configured as above. Next, the operations thereof will be described. In the description below, the unclamping state illustrated in FIG. 4 is defined as an initial position.

In this initial position, the pressurized fluid supply source supplies pressurized fluid to the rod-side cylinder chamber 46 via the first port 40 and discharges pressurized fluid from the cap-side cylinder chamber 48 via the second port 42. Thus, the piston 30 is disposed on the Z2 side, and the piston rod 32 and the joint 66 are also disposed on the Z2 side according to the position of the piston 30 on the Z2 side.

In the unclamping state, the joint 66 is disposed on the Z2 side separated from the lever arm 80 of the driving force transmission section 26. The joint 66 disposed at the initial position pulls the link arms 78 of the driving force transmission section 26, so that the link arms 78 extend approximately in the Z direction. This causes the first end of the lever arm 80 to be disposed above the joint 66 (on the Z1 side). Thus, the driving force transmission roller 88 rotatably supported by the lever arm 80 is also disposed above the joint 66, and the clamp arm 14 connected with the lever arm 80 is also separated from the support structure 16 to be substantially orthogonal to the support structure 16. Here, the protruding length of the first gripper 94 of the clamp arm 14 is adjusted to clamp the thin, flat workpiece W.

While the clamp arm 14 is in the unclamping state, the joint 66 is disposed on the Z2 side. Thus, the push roller 110 of the push mechanism 100 is not in contact with the joint 66. The bias receiving portion 118 of the roller holder 112 pushed by the compression spring 114 is in contact with the first housing 18, and thus the push roller 110 enters the accommodation space 54 to its maximum.

During clamping operation of the clamping device 10, pressurized fluid is supplied from the pressurized fluid supply source to the cap-side cylinder chamber 48 via the second port 42, and pressurized fluid in the rod-side cylinder chamber 46 is discharged from the first port 40. This causes the piston 30 to be pushed toward the first housing 18 (the Z1 side), and the piston rod 32 and the joint 66 are displaced toward the Z1 side in an integrated manner.

The joint 66 is displaced toward the Z1 side along the pair of guide grooves 84 while causing the guide rollers 82 to roll, and the link arms 78 are rotated clockwise around the first pin 78*a* during the displacement. The lever arm 80 is rotated as the link arms 78 are rotated, and the clamp arm 14 is also rotated clockwise around the support pin 86.

The joint 66 comes into contact with the driving force transmission roller 88 of the lever arm 80 during displacement toward the Z1 side. This causes the driving force transmission roller 88 to roll along the guide surface 74. The driving force transmission roller 88 first comes into contact with the inclined end part 74*a* to support the clockwise rotation of the lever arm 80. Then, while being displaced further toward the Z1 side, the joint 66 comes into contact with the push roller 110 entering the accommodation space 54. This causes the push roller 110 to roll along the push surface 76. The push roller 110 first rolls on the inclined end part 76*a* to gradually apply pushing force to the displacement body 36.

Figure 5:
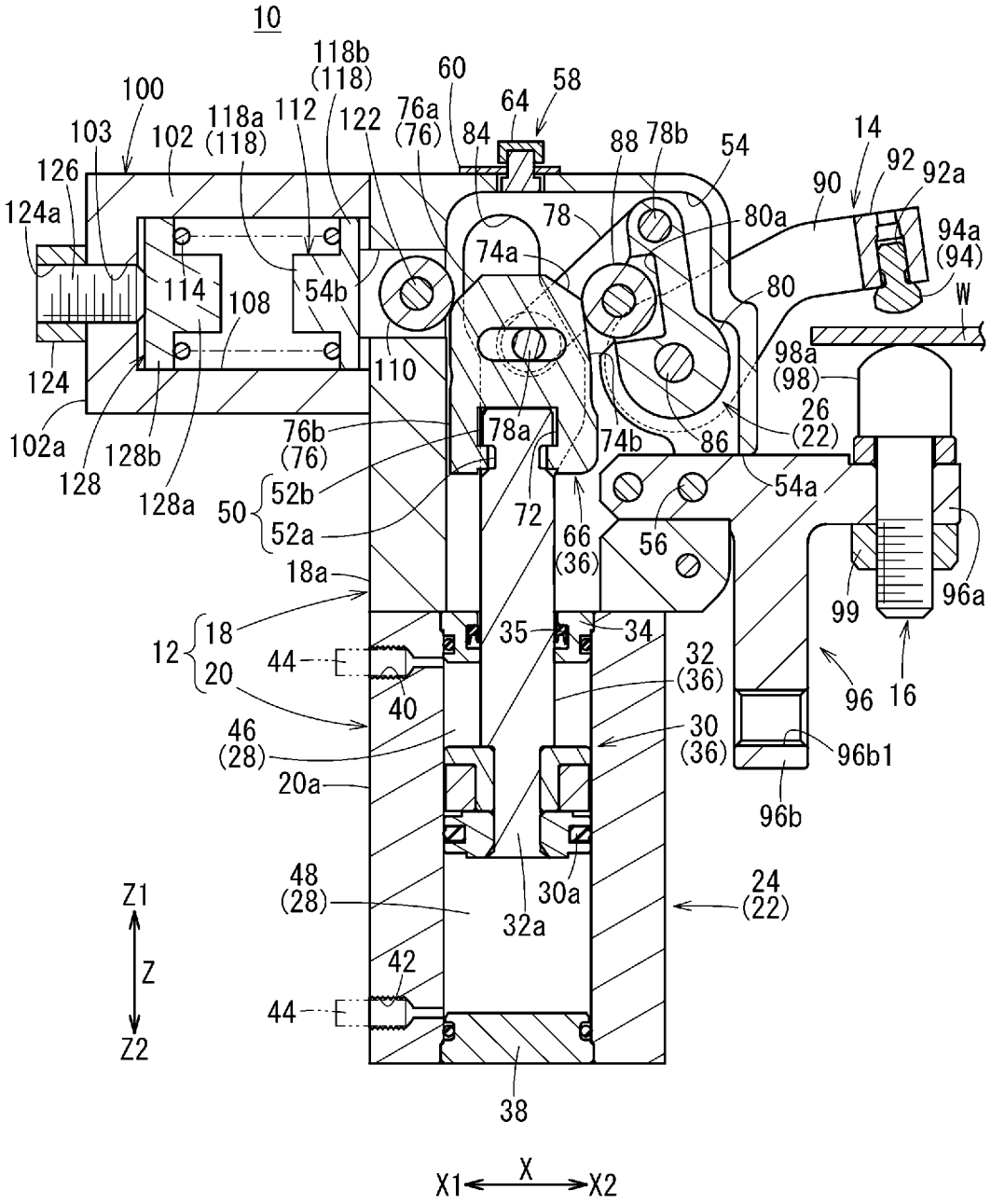
FIG. 5 is a side cross-sectional view illustrating the clamping device in clamping operation.
Figure 6A:
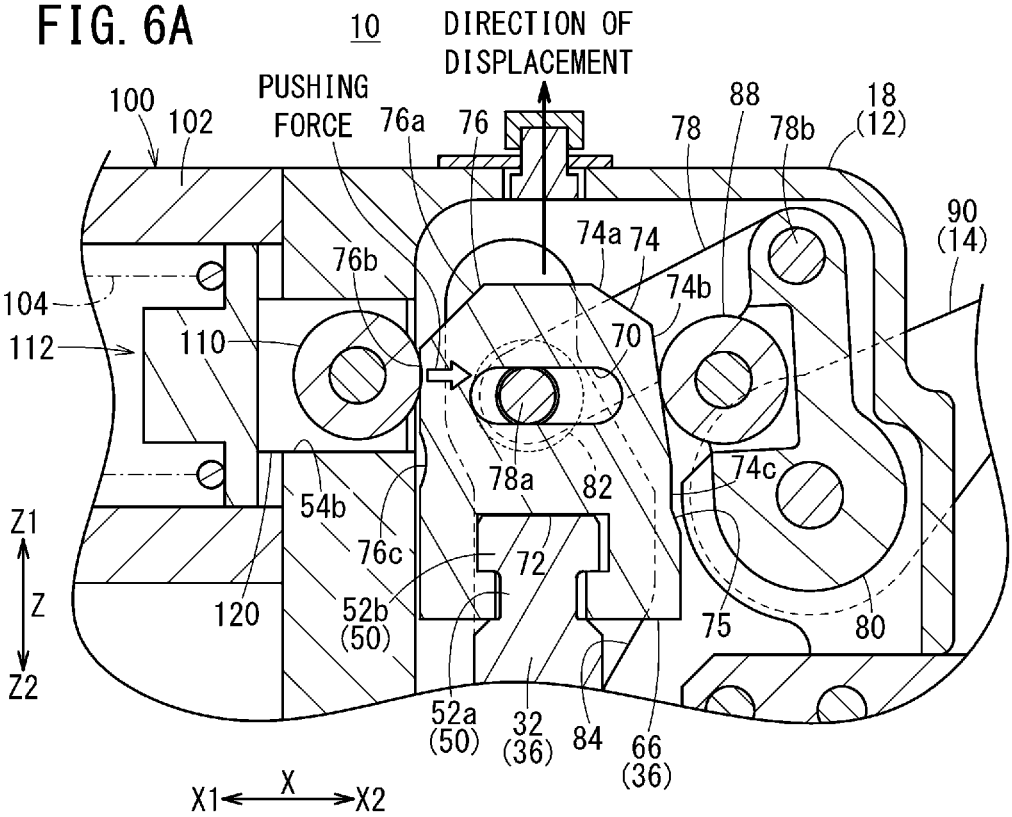
FIG. 6A is a first diagram illustrating the motion of a joint, a link structure, and the push mechanism when the joint is displaced upward.

As illustrated in FIG. 5, when the clamp arm 14 is rotated and comes close to the workpiece W to some extent (for example, at a position where the distance between the first gripper 94 and the second gripper 98 reaches a predetermined value of 3.5 mm), the push roller 110 shifts from the inclined end part 76*a* to the push surface-side parallel part 76*b* (hereinafter referred to as "push starting point"). The push roller 110 then rolls on the push surface-side parallel part 76*b* while pushing the joint 66 in the direction toward the X2 side that is orthogonal to the direction of displacement. As illustrated in FIG. 6A, there is a clearance between the connection recess 72 and the connection portion 50 of the piston rod 32, so that the joint 66 can move a small distance toward the X2 side when pushed by the push roller 110.

At the push starting point, the driving force transmission roller 88 has shifted to the inclined intermediate part 74*b* of the guide surface 74. The joint 66 moves a small distance toward the X2 side, so that the contact pressure between the inclined intermediate part 74*b* and the driving force transmission roller 88 is increased. This enables the driving force transmission roller 88 to reliably roll along the inclined intermediate part 74*b*. Moreover, although the joint 66 is held between the driving force transmission roller 88 and the push roller 110, the rollers roll so that the joint 66 can be smoothly displaced toward the Z1 side.

Figure 6B:
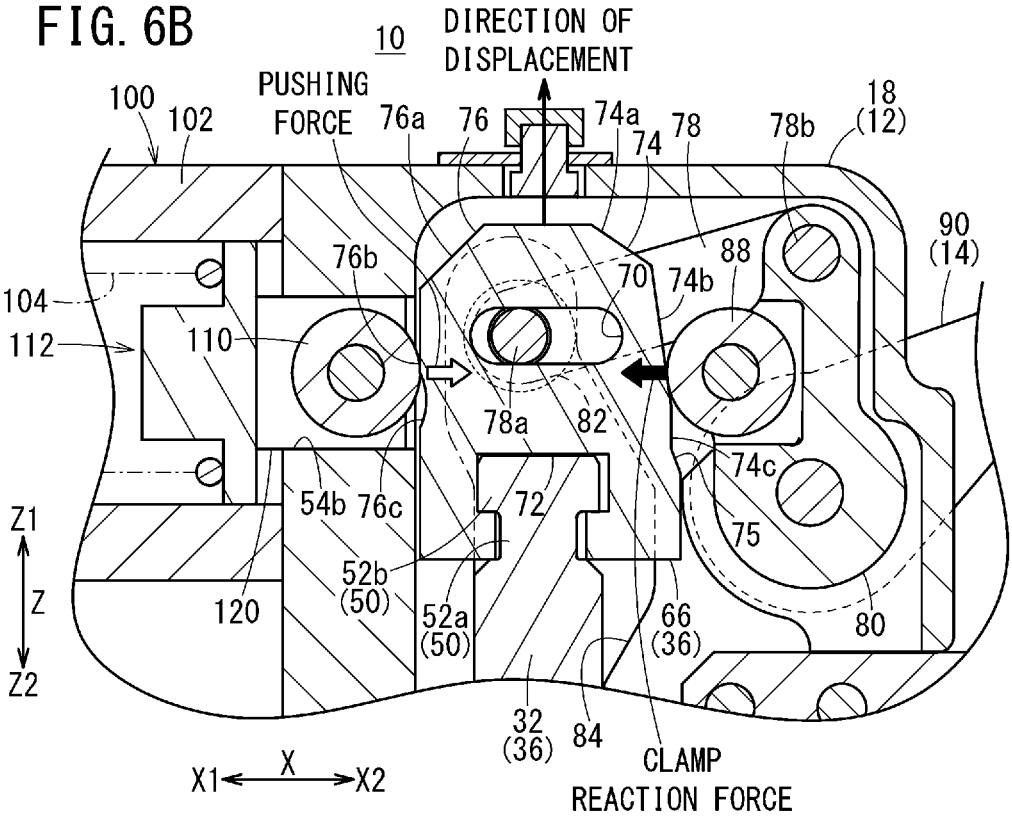
FIG. 6B is a second diagram illustrating the motion of the joint, the link structure, and the push mechanism subsequent to FIG. 6A.

When the clamp arm 14 first clamps the workpiece W (hereinafter referred to as "clamp starting point"), as illustrated in FIG. 6B, the driving force transmission roller 88 is disposed on the inclined intermediate part 74*b* on the Z2 side (adjacent to the guide surface-side parallel part 74*c*). Depending on the thickness of the workpiece W, the clamp starting point is a position where, for example, the distance between the first gripper 94 and the second gripper 98 reaches 2.5 mm or less. At this moment, the lever arm 80 receives a clamp reaction force from the clamp arm 14 brought into contact with the workpiece W, and pushes the joint 66 toward the X1 side using the driving force transmission roller 88. Thus, the push roller 110 allows the joint 66 to be continuously displaced toward the Z1 side while being elastically displaced toward the X1 side against the biasing force of the compression spring 114. Conversely speaking, the push roller 110 allows the joint 66 to be displaced while elastically pushing the joint 66 toward the X2 side against the clamp reaction force. In this manner, even when the thickness of the workpiece W varies due to, for example, dimensional errors, the clamping device 10 allows the dimensional errors, and causes the joint 66 to be displaced such that the lever arm 80 (driving force transmission roller 88) is rotated along the inclined intermediate part 74*b*.

As a result, as illustrated in FIG. 3, the driving force transmission roller 88 is disposed on the guide surface-side parallel part 74*c* while the clamp arm 14 is clamping the workpiece W, that is, in the clamping state. The driving force transmission roller 88 is disposed on the guide surface-side parallel part 74*c* parallel to the direction of displacement of the joint 66, so that no component of the clamp reaction force from the clamp arm 14 toward the Z2 side is applied to the joint 66. That is, the rolling of the driving force transmission roller 88 is controlled while the clamp arm 14 is in the clamping state, and, as a result, a state where the rotation of the lever arm 80 and the rotation of the clamp arm 14 are locked (controlled) is established in a preferred manner.

In particular, while the clamp arm 14 is in the clamping state, the driving force transmission roller 88 and the push roller 110 are disposed at the same height in the Z direction with the joint 66 interposed therebetween. That is, while the clamp arm 14 is in the clamping state, extension of the push roller 110 in the pushing direction overlaps with the position of the driving force transmission roller 88. Thus, the push roller 110 elastically pushes the joint 66 toward the lever arm 80 to apply a large pushing force to the driving force transmission roller 88, resulting in reinforcement of the lock of the clamping state.

Furthermore, while the clamp arm 14 is in the clamping state, the push roller 110 fits in the concave part 76*c* of the push surface 76. Even when the push roller 110 fits in the concave part 76*c*, the pushing force of the push roller 110 against the joint 66 does not substantially decrease as the concave part 76*c* is shallow. On the other hand, the push roller 110 and the concave part 76*c* engage with each other, so that the displacement of the joint 66 toward the Z2 side is further prevented. This enables the clamping state of the clamping device 10 to be maintained in a more preferred manner. Note that the push surface 76 may not be provided with the concave part 76*c*.

When the workpiece W is released from the clamped state, pressurized fluid is supplied to the rod-side cylinder chamber 46, and, at the same time, pressurized fluid is discharged from the cap-side cylinder chamber 48. This causes the piston 30 to move in a direction along which the piston 30 is separated from the first housing 18 (Z2 direction). As a result, the piston rod 32 and the joint 66 are displaced in an integrated manner. Since the joint 66 is pulled and displaced toward the Z2 side, the driving force transmission roller 88 and the push roller 110 pushing each other in the X direction also respectively roll on the guide surface 74 and the push surface 76 easily. As the joint 66 is displaced in the Z2 direction, the link arms 78 are rotated counterclockwise around the first pin 78*a*, and the lever arm 80 and the clamp arm 14 are also rotated counterclockwise around the support pin 86. That is, the clamp arm 14 is separated from the support structure 16, and thus the workpiece W is released from the clamped state.

When the workpiece W is in the clamped state, in a case where supply of pressurized fluid is stopped and the workpiece W is kept in the clamped state, an operator can push the releasing pin 64 of the unclamping mechanism 58. This causes the leading end of the releasing pin 64 to move toward and come into contact with the joint 66 to push the joint 66 toward the Z2 side. As a result, the joint 66 can be displaced toward the drive section 24. Also in this case, the driving force transmission roller 88 and the push roller 110 respectively roll on the guide surface 74 and the push surface 76 easily to allow the joint 66 to be displaced.

The present invention is not limited in particular to the embodiment described above, and various modifications can be made thereto without departing from the scope of the present invention. For example, the clamping device 10 may have various other structures instead of the structure causing the clamp arm 14 to be rotated by the driving force of the drive section 24 converted via the link structure 68. For example, the clamping device 10 may have a structure in which the piston rod 32 (displacement body 36) comes into direct contact with the clamp arm 14 to rotate the clamp arm 14 as the piston rod 32 is displaced. Also in this case, the clamping state can be strengthened by providing the guide surface 74 described above for the piston rod 32 at a part that is in contact with the clamp arm 14 and by pushing the surface opposite the guide surface 74 using the push mechanism 100.

Moreover, the structure of the push mechanism 100 is not limited by the structures of the push roller 110, the compression spring 114, and other components. For example, the push mechanism 100 may include an elastic projection (not illustrated) on the inner surface of the first housing 18 at a position facing the clamp arm 14 or the lever arm 80 to elastically push the joint 66 toward the X2 side. In order for the elastic projection to come into sliding contact with the joint 66, the frictional coefficient thereof may be sufficiently low.

The technical scope and effects that can be understood from the above-described embodiment will be described below.

The clamping device 10 includes the push mechanism 100 elastically pushing the displacement body 36, so that the guide surface 74 of the displacement body 36 can be brought into firm contact with the clamp arm 14 or the rotation portion (lever arm 80) while the clamp arm 14 is in the clamping state. Moreover, the push mechanism 100 allows the displacement body 36 to be displaced in the direction of displacement without obstructing the displacement body 36. Thus, the reliability of the lock (rotation control) of the clamp arm 14 increases, resulting in an excellent clamping state even when, for example, the size of the clamping device 10 is small. In addition, even when the clamp arm 14 is in the clamping state, the elastic push of the push mechanism 100 provides a lock range allowing variations in the thickness of the workpiece W by displacing the displacement body 36 a certain distance. Thus, the clamping device 10 allows the dimensional errors in the workpiece W and the clamping device 10 and demonstrates stable clamping force.

The guide surface 74 includes an inclined part (inclined intermediate part 74*b*) inclined with respect to the direction of displacement of the displacement body 36 and the guide surface-side parallel part 74*c* adjoining the inclined part and extending parallel to the direction of displacement, and the clamp arm 14 or the rotation portion (lever arm 80) is disposed on the guide surface-side parallel part 74*c* while the clamp arm 14 is in the clamping state. In the clamping device 10, the clamp arm 14 or the lever arm 80 moves along the inclined intermediate part 74*b* inclined with respect to the direction of displacement of the displacement body 36 while the displacement body 36 is displaced. Thus, the displacement body 36 can move smoothly even while being pushed by the push mechanism 100. In addition, the clamp arm 14 or the lever arm 80 is disposed on the guide surface-side parallel part 74*c* while the clamp arm 14 is in the clamping state. Thus, the displacement body 36 is reliably prevented from being displaced even when the displacement body 36 receives reaction force from the clamp arm 14 or the lever arm 80.

Moreover, the displacement body 36 is configured to be movable a small distance in the direction orthogonal to the direction of displacement of the displacement body 36, and the push mechanism 100 pushes the displacement body 36 in the orthogonal direction. Thus, the clamping device 10 pushes the displacement body 36 more firmly toward the clamp arm 14 or the lever arm 80 to lock the clamp arm 14 more reliably using the displacement body 36.

Moreover, the push mechanism 100 includes the push roller 110 rolling on the displacement body 36 while in contact with the displacement body 36 or the contact body having a low frictional coefficient and coming into contact with the displacement body 36. The push mechanism 100 further includes the biasing member (compression spring 114) biasing the push roller 110 or the contact body. The push mechanism 100 includes the push roller 110 (or contact body) and the compression spring 114, so that the push roller 110 pushes the displacement body 36 during the displacement of the displacement body 36. Thus, the displacement body 36 can be displaced more smoothly in the direction of displacement while being reliably pushed.

Moreover, the drive mechanism 22 includes the driving force transmission section 26 having the rotation portion (lever arm 80) and converting the displacement of the displacement body 36 into the rotational motion of the clamp arm 14, and the rotation portion includes the driving force transmission roller 88 capable of rolling along the guide surface 74. Thus, the lever arm 80 rotates itself while causing the driving force transmission roller 88 to roll along the guide surface 74 during the displacement of the displacement body 36. As a result, the lever arm 80 can rotate the clamp arm 14 in a more preferred manner.

Moreover, while the clamp arm 14 is in the clamping state, extension of the push roller 110 or the contact body in the pushing direction overlaps with the position of the driving force transmission roller 88. Thus, in the clamping device 10, the displacement body 36 is held between the push roller 110 (or the contact body) and the driving force transmission roller 88 while the clamp arm 14 is in the clamping state. This causes the pushing force of the push roller 110 to be reliably transmitted to the driving force transmission roller 88, and thus the clamping state can be maintained more firmly.

Moreover, the displacement body 36 includes the push surface 76 pushed by the push roller 110 or the contact body. The push surface 76 includes the push surface-side parallel part 76*b* parallel to the direction of displacement of the displacement body 36 and the concave part 76*c* provided at an area with which the push roller 110 or the contact body is in contact while the clamp arm 14 is in the clamping state. In the clamping device 10, the push roller 110 rolls on the push surface-side parallel part 76*b* to allow the displacement body 36 to be smoothly displaced in the direction of displacement. In addition, the push roller 110 (or the contact body) fits in the concave part 76*c* while the clamp arm 14 is in the clamping state. This enables the displacement of the displacement body 36 in the direction of displacement to be controlled more reliably, allowing the lock to be maintained.

Moreover, the push mechanism 100 includes the adjuster 116 adjusting the biasing force of the biasing member (compression spring 114). The clamping device 10 includes the adjuster 116, so that the pushing force of the push roller 110 by the push mechanism 100 can be adjusted. As a result, the contact force applied by the displacement body 36 to the clamp arm 14 or the lever arm 80 is adjusted, and an appropriate clamping force is obtained. Thus, for example, the clamped state of the workpiece W can be maintained in a preferred manner even when the clamping device 10 ages.

Moreover, the drive mechanism 22 includes the drive section 24 displacing the displacement body 36 based on supply and discharge of pressurized fluid. Thus, in the clamping device 10, the displacement body 36 can be stably advanced or returned in the direction of displacement even when the push mechanism 100 pushes the displacement body 36.

Moreover, the connectors 44 for supplying and discharging pressurized fluid are attached to a side surface (sidewall 20*a*) of the body 12, and the push mechanism 100 is attached to the side surface 18*a* on the same side as the side surface to which the connectors 44 are attached. In the clamping device 10, the push mechanism 100 is disposed on the side surface to which the connectors 44 for pressurized fluid are attached, to utilize a space above the connectors 44 extending in a direction along which the push mechanism 100 protrudes. That is, the push mechanism 100 occupies little space during use of the clamping device 10. This structure prevents interference with peripheral devices and facilitates the installation.

The invention claimed is:

1. A clamping device comprising:

a body;

a clamp arm rotated relative to the body and configured to hold a workpiece between the clamp arm and a support structure to create a clamping state;

a drive mechanism including a displacement body displaced linearly, and configured to convert displacement of the displacement body into rotational motion of the clamp arm via a link mechanism, the displacement body comprising a piston rod and a joint that is connected with the piston rod; and a push mechanism disposed at a position facing the clamp arm or a rotation portion rotated in an integrated manner with the clamp arm, the push mechanism being configured to come into contact with the displacement body to elastically push the displacement body toward the clamp arm or the rotation portion while the displacement body is displaced, wherein the displacement body includes a guide surface coming into contact with the clamp arm or the rotation portion to guide rotation of the clamp arm, and also to control the rotation of the clamp arm while the clamp arm is in the clamping state, wherein:

the guide surface includes an inclined part inclined with respect to a direction of displacement of the displacement body, and a guide surface-side parallel part adjoining the inclined part and extending parallel to the direction of displacement; and the clamp arm or the rotation portion is disposed on the guide surface-side parallel part while the clamp arm is in the clamping state.

2. The clamping device according to claim 1, wherein:

the displacement body is configured to be movable in a direction orthogonal to the direction of displacement of the displacement body; and the push mechanism pushes the displacement body in the orthogonal direction.

3. The clamping device according to claim 1, wherein:

the push mechanism includes:

a push roller rolling on the displacement body while in contact with the displacement body, or a contact body having a low frictional coefficient and coming into contact with the displacement body; and a biasing member configured to bias the push roller or the contact body.

4. The clamping device according to claim 3, wherein:

the drive mechanism includes a driving force transmission section having the rotation portion and configured to convert the displacement of the displacement body into rotational motion of the clamp arm; and the rotation portion includes a driving force transmission roller configured to roll along the guide surface.

5. A clamping device, comprising:

a body;

a clamp arm rotated relative to the body and configured to hold a workpiece between the clamp arm and a support structure to create a clamping state;

a drive mechanism including a displacement body displaced linearly, and configured to convert displacement of the displacement body into rotational motion of the clamp arm via a link mechanism, the displacement body comprising a piston rod and a joint that is connected with the piston rod; and a push mechanism disposed at a position facing the clamp arm or a rotation portion rotated in an integrated manner with the clamp arm, the push mechanism being configured to come into contact with the displacement body to elastically push the displacement body toward the clamp arm or the rotation portion while the displacement body is displaced, wherein the displacement body includes a guide surface coming into contact with the clamp arm or the rotation portion to guide rotation of the clamp arm, and also to control the rotation of the clamp arm while the clamp arm is in the clamping state, wherein the push mechanism includes:

a push roller rolling on the displacement body while in contact with the displacement body, or a contact body having a low frictional coefficient and coming into contact with the displacement body, and a biasing member configured to bias the push roller or the contact body, wherein the drive mechanism includes a driving force transmission section having the rotation portion and configured to convert the displacement of the displacement body into rotational motion of the clamp arm, wherein the rotation portion includes a driving force transmission roller configured to roll along the guide surface, and wherein extension of the push roller or the contact body in a pushing direction overlaps with a position of the driving force transmission roller while the clamp arm is in the clamping state.

6. A clamping device comprising:

a body;

a clamp arm rotated relative to the body and configured to hold a workpiece between the clamp arm and a support structure to create a clamping state;

a drive mechanism including a displacement body displaced linearly, and configured to convert displacement of the displacement body into rotational motion of the clamp arm via a link mechanism, the displacement body comprising a piston rod and a joint that is connected with the piston rod; and a push mechanism disposed at a position facing the clamp arm or a rotation portion rotated in an integrated manner with the clamp arm, the push mechanism being configured to come into contact with the displacement body to elastically push the displacement body toward the clamp arm or the rotation portion while the displacement body is displaced, wherein the displacement body includes a guide surface coming into contact with the clamp arm or the rotation portion to guide rotation of the clamp arm, and also to control the rotation of the clamp arm while the clamp arm is in the clamping state, wherein the push mechanism includes:

a push roller rolling on the displacement body while in contact with the displacement body, or a contact body having a low frictional coefficient and coming into contact with the displacement body, and a biasing member configured to bias the push roller or the contact body, wherein the displacement body includes a push surface pushed by the push roller or the contact body; and wherein the push surface includes a push surface-side parallel part parallel to the direction of displacement of the displacement body, and a concave part provided at an area with which the push roller or the contact body is in contact while the clamp arm is in the clamping state.

7. The clamping device according to claim 3, wherein the push mechanism includes an adjuster configured to adjust biasing force of the biasing member.

8. The clamping device according to claim 1, wherein the drive mechanism includes a drive section configured to displace the displacement body based on supply and discharge of pressurized fluid.

9. The clamping device according to claim 8, wherein:

a connector configured to supply and discharge the pressurized fluid is attached to a side surface of the body; and the push mechanism is attached to a side surface on a same side as the side surface to which the connector is attached.

* * * * *